US005148927A

United States Patent [19]

Gebka

[11] Patent Number: 5,148,927

[45] Date of Patent: Sep. 22, 1992

[54] PIN MOUNT SHELF DIVIDER

[75] Inventor: John Gebka, Chicago Heights, Ill.

[73] Assignee: Fast Industries Inc., Ft. Lauderdale, Fla.

[21] Appl. No.: 741,656

[22] Filed: Aug. 7, 1991

[51] Int. Cl.[5] ..... A47F 5/00

[52] U.S. Cl. ..... 211/184; 108/60

[58] Field of Search ..... 211/184, 43; 108/60, 108/61

[56] References Cited

U.S. PATENT DOCUMENTS

| | | | |
|---|---|---|---|
| 435,877 | 9/1890 | Yawman | 108/60 |
| 568,910 | 10/1896 | Knowles | 211/184 X |
| 1,758,307 | 5/1930 | Bales | 211/184 X |
| 2,118,444 | 5/1938 | Mueller | 211/184 X |
| 2,601,201 | 6/1952 | Bales | 108/60 |
| 2,884,139 | 4/1959 | Dunham | 211/184 |
| 3,497,081 | 2/1970 | Field | 211/184 |
| 3,954,184 | 5/1976 | Mendenhall | 211/184 |
| 4,191,299 | 3/1980 | Moore | 211/184 |
| 4,618,063 | 10/1986 | Mendenhall | 211/184 |
| 4,942,968 | 7/1990 | Fast | 211/184 |

*Primary Examiner*—Robert W. Gibson, Jr.
*Assistant Examiner*—Korie H. Chan
*Attorney, Agent, or Firm*—Fleit, Jacobson, Cohn, Price, Holman & Stern

[57] ABSTRACT

A shelf divider is designed for use on a shelf having rows of apertures extending along the front and back of the shelf. The divider is made of plastic sheet with a vertical divider panel and a horizontal attachment panel. A tongue at the front end of the attachment panel is inserted in a selected aperture at the front of the shelf. A perforation in the attachment panel aligned with the tongue is positioned to overlie a corresponding aperture at the back of the shelf. To releasably attach the divider to the shelf, a push-in plastic pin is inserted in the perforation and corresponding aperture. The divider is formed with tongues and perforations at both ends to make it reversible.

3 Claims, 1 Drawing Sheet

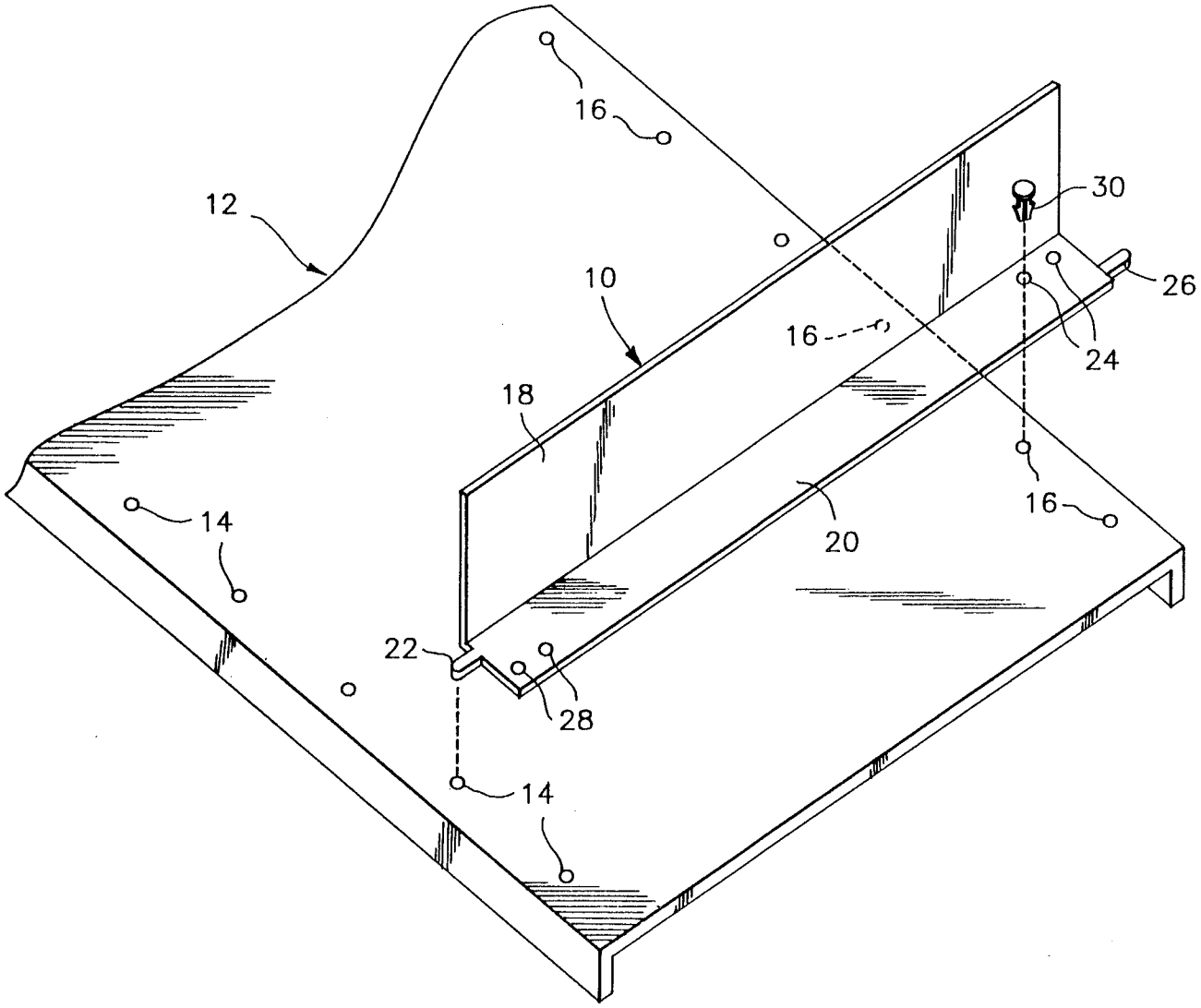
26
30
24
16
16
20
16
10
18
28
14
22
12
14

PIN MOUNT SHELF DIVIDER

BACKGROUND OF THE INVENTION

On product display or storage shelving, such as in supermarkets, warehouses and the like, it is frequently necessary to divide a shelf lengthwise into discrete storage areas for different products. Furthermore, depending on the products to be shelved, it may be necessary from time to time to change the lengths of the respective storage areas. Accordingly, use is made attachable-detachable shelf dividers which can be attached to a shelf at suitable locations to define the respective areas and which can be moved along the shelf, if required, to adjust the lengths of such areas. The invention relates to a shelf divider of this kind.

SUMMARY OF THE INVENTION

It is an object of the invention to provide a shelf divider for use on shelving of the type having rows of apertures running along the front and back of a shelf.

It is another object of the invention to provide a shelf divider for a shelf of the above kind which can be mounted on the shelf in reversed positions respectively and provide a small adjustment in the lengths of respective areas defined thereby in the reversed positions.

A further object of the invention is to provide a shelf divider as specified which is economically produced from plastic sheet and which is simple to securely attach and detach from a shelf for repeated use.

With the above and other objects in view, the invention provides a shelf divider for the purpose indicated which is made of stiffish plastic sheet material having a vertical divider panel and a horizontal attachment flange extending from the base of the divider panel. The length of the attachment flange is related to the width of a shelf. Projecting at one end of the attachment flange is a thin elongate tongue or tab and at the opposite end of the attachment panel is a perforation aligned with the tongue. The distance between the tongue and the perforation, lengthwise of the divider, is made to conform with the spacing between rows of apertures at the front and back of a shelf on which the divider is to be used. To attach the divider, the tongue is inserted into a selected aperture at the front of the shelf and a push-fit headed plastic pin (of a kind which is known per se) is inserted through the perforation in the divider and the corresponding aperture at the back of the shelf. The pin head will protrude slightly from the attachment flange and is used at the back of the shelf so as not to obstruct the storage space at the front.

In a preferred form of the invention, the divider has a second tongue projecting from the opposite end of the attachment flange, laterally offset from the first tongue, and a second perforation at the one end aligned with the second tongue. This allows the divider to be attached to a shelf in reversed positions with the divider panel offset somewhat in the respective positions to provide a slight adjustment in the lengths of storage areas defined on opposite sides of the divider.

Furthermore, the attachment panel may have a pair of perforations (spaced apart lengthwise) at the respective ends to allow for variations in the distance between the front and back shelf apertures.

Additional features and advantages of the invention will become apparent from the ensuing description and claims read in conjunction with the attached drawing.

BRIEF DESCRIPTION OF DRAWING

The single drawing FIGURE a perspective view of a shelf divider according to the invention showing the manner in which it is attached to a shelf.

DESCRIPTION OF PREFERRED EMBODIMENT

A shelf divider 10 according to the invention is designed primarily for use on a shelf 12 of the type having at least one row of apertures 14 along the front of the shelf and another row of apertures 16 along the back of the shelf.

The divider 10 is made of stiffish plastic sheet material and has a vertical divider panel 18 and a horizontal attachment flange 20 extending from the base of the divider panel. (The divider may be folded from a flat blank having a fold line between the panel 18 and flange 20.) The length of the attachment flange is related to the width of shelf 12. Extending from one end of the attachment flange 20 there is a thin elongate first tongue 22 adjacent the divider panel and at the opposite end of the attachment flange are a pair of longitudinally spaced first perforations 24 aligned with tongue 22. The distance between tongue 22 and one of the perforations 24 corresponds to the distance between the rows of apertures 14 and 16. There are two perforations to allow for slight variations in this distance or for shelves having plural rows of apertures front or back. The width of the tongue and dimensions of the perforations correspond substantially to the apertures 14 and 16.

Extending from the opposite end of the attachment flange 20 there is a second tongue 26 corresponding to but laterally offset from first tongue 22. A second pair of perforations 28 is provided at the first end of the panel corresponding to perforations 24, and aligned with tongue 26.

In use, with the divider 10 oriented as shown with respect to shelf 12, the tongue 22 may be inserted into a selected one of the apertures 14 at the front of the shelf. To attach the back end of the divider to the shelf, use is made of a known form of headed, bifurcated plastic pin 30, the bifurcations having arrowhead ends, and the pin being push-fitted into a respective one of the perforations 24 and one of apertures 16 aligned with the selected aperture 14. The divider can also, however, be attached to the shelf in a reverse orientation with the second tongue 26 inserted in the selected front aperture 14 and pin 30 inserted in one of the perforations 28 and the respective back aperture 16. It will be seen that in the reversed positions of the divider, the location of the divider panel 18 lengthwise of the shelf will be altered so that a degree of adjustment is provided to the lengths of the shelf area on opposite sides of the divider depending on which orientation is used.

While only a preferred embodiment of the invention has been described herein in detail, the invention is not limited thereby and modifications can be made within the scope of the attached claims. For example, the tongues 22 and 26 could be cut-outs in the flange 20 rather than extending from the ends thereof.

I claim:

1. A shelf divider of sheet material comprising an elongate divider panel, an elongate attachment flange extending substantially perpendicularly from the divider panel, a single first tongue at a first end of the attachment flange, a first perforation in the attachment flange adjacent a second end of the attachment flange opposite said first end and aligned with the first tongue, a single second tongue at the second end of the attachment flange laterally offset from said first tongue, and a second perforation in the attachment flange adjacent the first end and aligned with the second tongue.

2. A shelf divider as claimed in claim 1, including a fold line between the divider panel and the attachment flange.

3. A shelf divider as claimed in claim 1 including a third perforation in the attachment flange adjacent the first perforation and aligned with the first tongue and a fourth perforation in the attachment flange adjacent the second perforation and aligned with the second tongue.

* * * * *